US008254812B2

(12) United States Patent
Huang et al.

(10) Patent No.: US 8,254,812 B2
(45) Date of Patent: Aug. 28, 2012

(54) DRIVING UNIT FOR PHOTO CONDUCTOR DRUM CARTRIDGE

(75) Inventors: Shih-Hsiung Huang, Taichung County (TW); Hsin-Yi Chen, Taichung County (TW)

(73) Assignee: General Plastic Industrial Co., Ltd., Taichung County (TW)

( * ) Notice: Subject to any disclaimer, the term of this patent is extended or adjusted under 35 U.S.C. 154(b) by 381 days.

(21) Appl. No.: 12/619,297

(22) Filed: Nov. 16, 2009

(65) Prior Publication Data

US 2011/0116836 A1 May 19, 2011

(51) Int. Cl.
*G03G 15/02* (2006.01)

(52) U.S. Cl. ..... 399/167; 399/90; 399/116; 399/159; 399/166

(58) Field of Classification Search ..... 399/116, 399/159, 167
See application file for complete search history.

(56) References Cited

U.S. PATENT DOCUMENTS

| | | | | |
|---|---|---|---|---|
| 6,185,393 | B1 * | 2/2001 | Karakama et al. | 399/103 |
| 6,771,915 | B2 * | 8/2004 | Cais et al. | 399/90 |
| 6,785,489 | B2 * | 8/2004 | Anderson, II | 399/90 |
| 2007/0231007 | A1 * | 10/2007 | Arakawa | 399/167 |
| 2008/0063429 | A1 * | 3/2008 | Watanabe et al. | 399/111 |

* cited by examiner

*Primary Examiner* — David Gray
*Assistant Examiner* — Francis Gray
(74) *Attorney, Agent, or Firm* — Muncy, Geissler, Olds & Lowe, PLLC

(57) ABSTRACT

A driving unit for a photo conductor drum cartridge is assembled with a shaft of the photo conductor drum cartridge, including a gear and a conducting plate mounted on the gear. The conducting plate is provided with an elastic arm and defines an imaginary axis parallel to the shaft. When the elastic arm of the conducting plate is perpendicular to the imaginary axis, a distance L is defined between a distal end of the elastic arm and the imaginary axis. The distance L is longer than or equal to a radius d of an annular groove portion of the shaft and shorter than a radius D of the shaft. By means of this design, the driving unit can be reusable and provide a convenient detachment of a photo conductor drum.

7 Claims, 15 Drawing Sheets

DRIVING UNIT FOR PHOTO CONDUCTOR DRUM CARTRIDGE

BACKGROUND OF THE INVENTION

1. Field of the Invention

The present invention relates generally to a photo conductor drum cartridge, and more specifically to a driving unit for a photo conductor drum cartridge that is reusable and provides a convenient detachment of a photo conductor drum from a shaft.

2. Description of the Related Art

FIGS. 1 and 2 show a conventional photo conductor drum cartridge 1 for use in a photocopier, comprising a housing 2, a shaft 3 mounted in the housing 2 and provided with an annual groove 91 at each of two opposite ends thereof for engagement with a C-shaped fastener 92 such that the shaft 3 can be rotatably mounted to the housing 2, a photo conductor drum 4 sleeved on the shaft 3, a support wheel 5 sleeved on the right end of the shaft 3 and engaged with the right end of the photo conductor drum 4, a driving wheel 6 sleeved on the left end of the shaft 3 and engaged with the left end of the photo conductor drum 4, a conducting plate 7 mounted on the driving wheel 6 in such a way that the outer periphery of the conducting plate 7 is abutted against the inner periphery of the photo conductor drum 4 and provided with a axial hole 8 for penetration of the shaft 3, and an elastic arm 9 extending from the periphery of the axial hole 8 and stopped against the shaft 3. Therefore, the inner periphery of the photo-conductor drum 4 can be electrically grounded through the conductor plate 7 and the shaft 3.

When the photo conductor drum cartridge 1 is assembled, the driving wheel 6 and the photo conductor drum 4 are engaged with each other firstly, and then the shaft 3 is inserted through the driving wheel 6 and the axial hole 8 of the conducting plate 7, as shown in FIGS. 3 and 4. When the shaft 3 is moved rightwards relative to the photo conductor drum 4, the shaft 3 will push the elastic arm 9 of the conducting plate 7 away to cause an elastic deformation of the elastic arm 9 such that the distal end of the elastic arm 9 can run over the annual groove 91 and then keep contacted with the shaft 3.

When the photo conductor drum 4 is malfunction and then needs to be repaired or replaced, a maintenance worker has to dismount the shaft 3 from the photo conductor drum 4. As shown in FIG. 5, when the shaft 3 is pulled leftwards relative to the photo conductor drum 4, the distal end of the elastic arm 9 may be jammed in the groove 91 to cause the distortion of the elastic arm 9. Under this circumstance, it can be seen that the shaft 3 will be difficultly drawn out from the driving wheel 6, and the conducting plate 7 will be easily damaged and then can not be reused.

SUMMARY OF THE INVENTION

It is one objective of the present invention to provide a driving unit for a photo conductor drum cartridge, which is reusable and allows a photo conductor drum to be detached therefrom conveniently.

The driving unit provided by the present invention is adapted to be assembled with a photo conductor drum cartridge having a housing, a shaft mounted in the housing and having a radius D, and a photo conductor drum sleeved on the shaft. The shaft has an annular groove portion defining a radius d that is shorter than the radius D. To achieve the above-mentioned objective of the present invention, the driving unit comprises a gear having a main body, an extending portion extending from the main body for inserting into the photo conductor drum, and an axial hole passing through the main body and the extending portion for penetration of the shaft, and a conducting plate having a plate body mounted on the extending portion of the gear for abutting against an inner periphery of the photo conductor drum, a through hole formed at the plate body for penetration of the shaft, and an elastic arm extending from the plate body for stopping against the shaft. The conducting plate defines an imaginary axis aligned with a center of the plate body and parallel to the shaft. When the elastic arm of the conducting plate is perpendicular to the imaginary axis, a distance L is defined between a distal end of the elastic arm and the imaginary axis. The distance L is longer than or equal to the radius d and shorter than the radius D.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
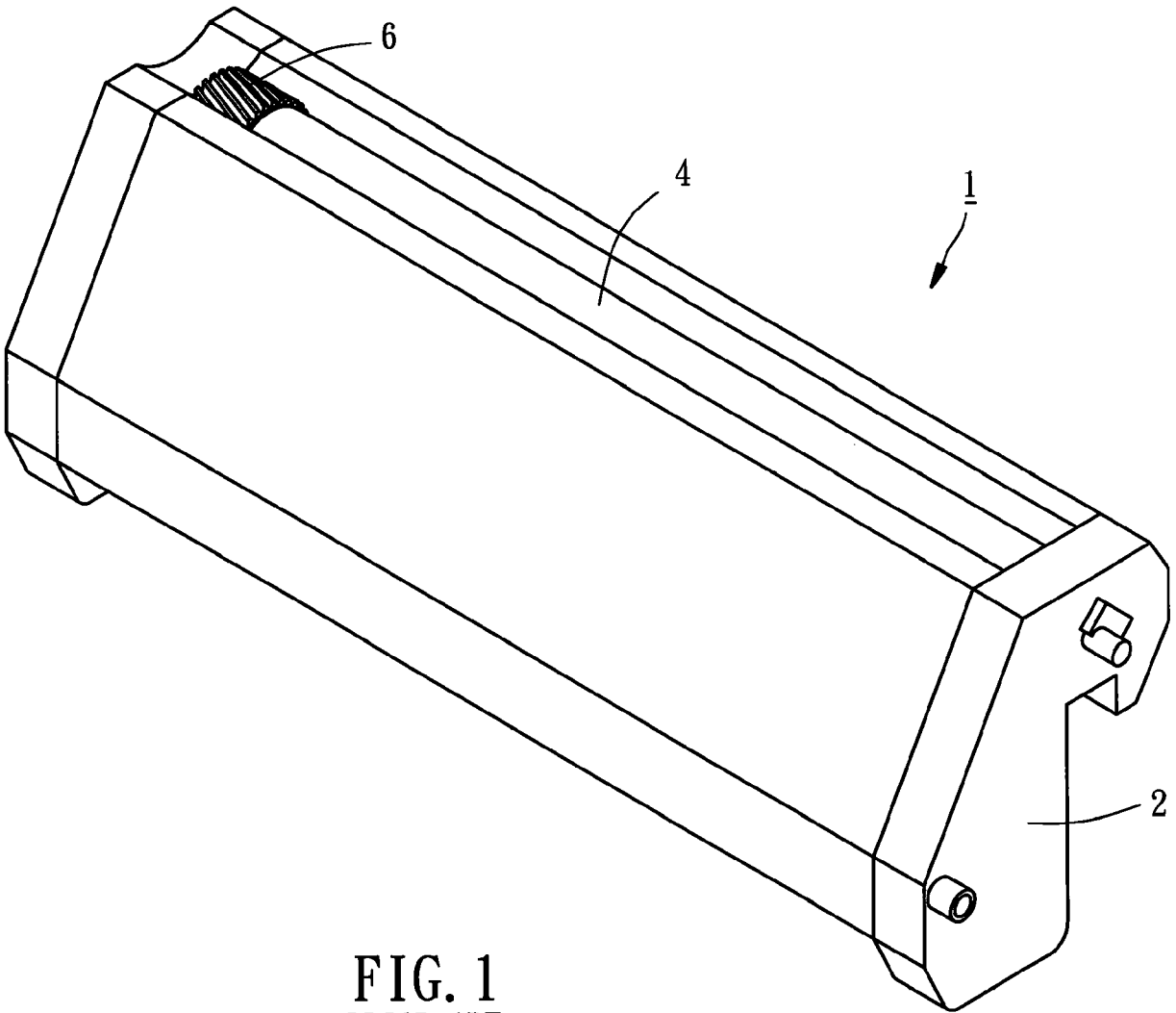
FIG. 1 PRIOR ART
FIG. 1 is a perspective view of a photo conductor drum cartridge according to a prior art.
Figure 2:
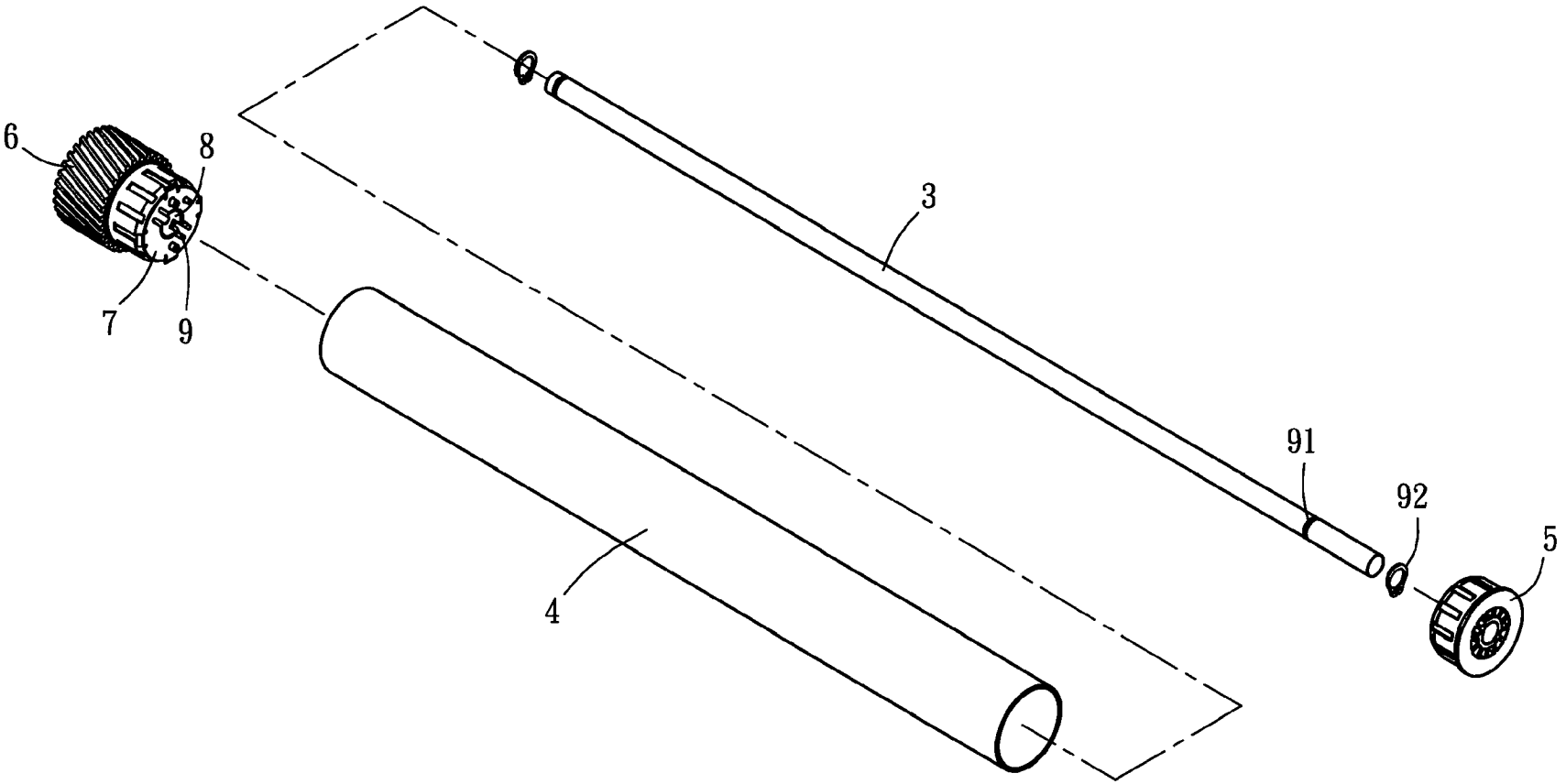
FIG. 2 PRIOR ART
FIG. 2 is a partial exploded view of the photo conductor drum cartridge according to the prior art.
Figure 3:
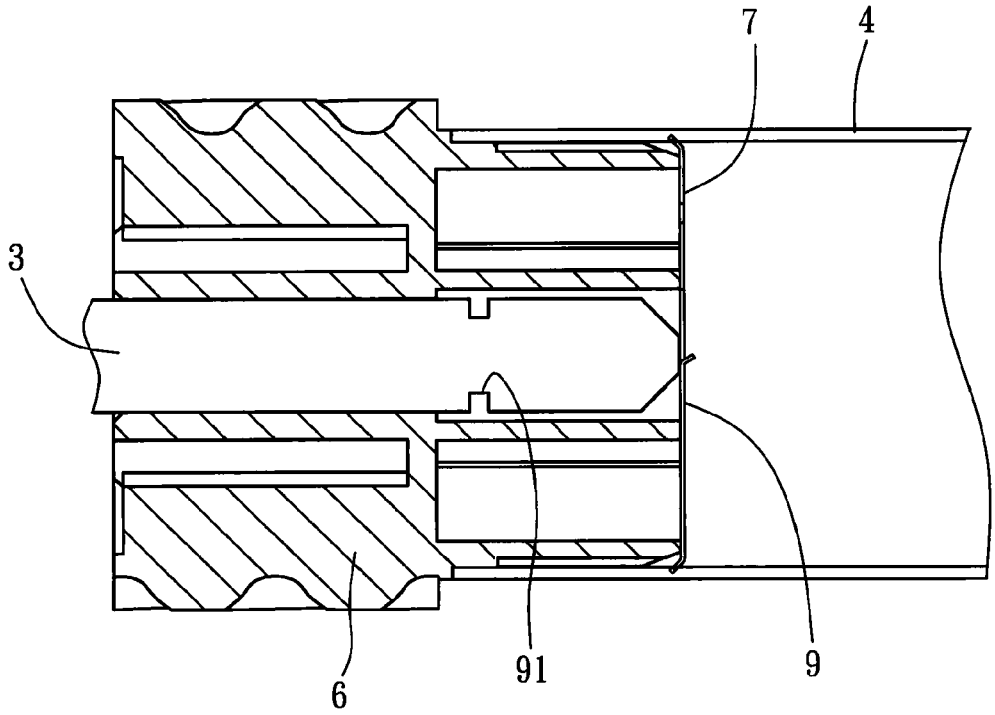
FIG. 3 PRIOR ART
FIG. 3 is a partial cutaway view of the photo conductor drum cartridge according to the prior art, showing the shaft is inserted into the driving wheel.
Figure 4:
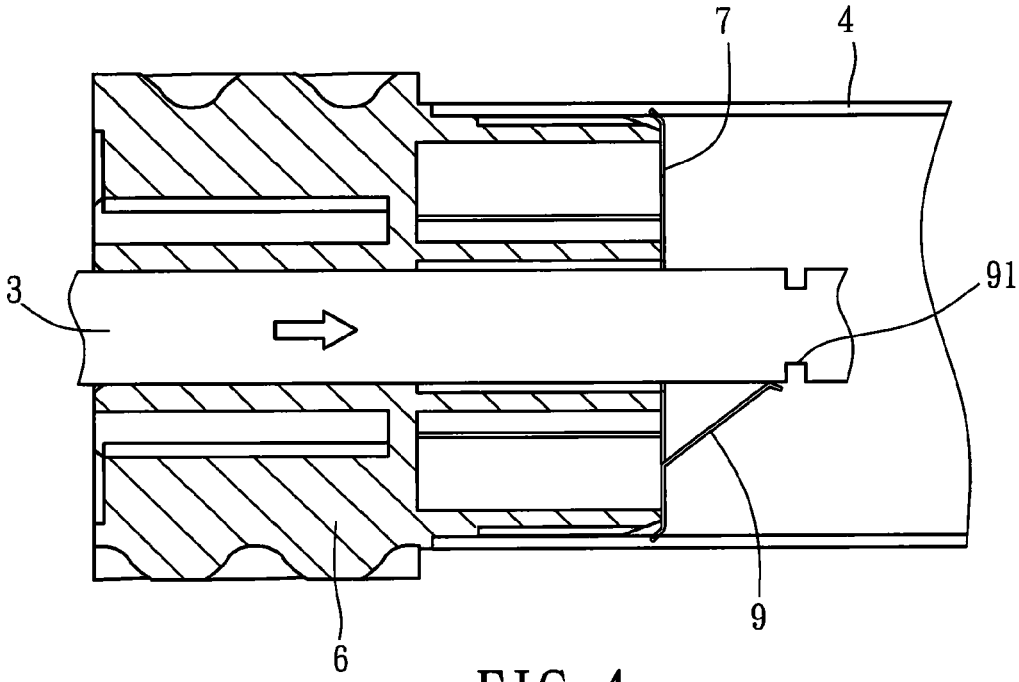
FIG. 4 PRIOR ART
FIG. 4 is similar to FIG. 3, showing the shaft is moved rightwards.
Figure 5:
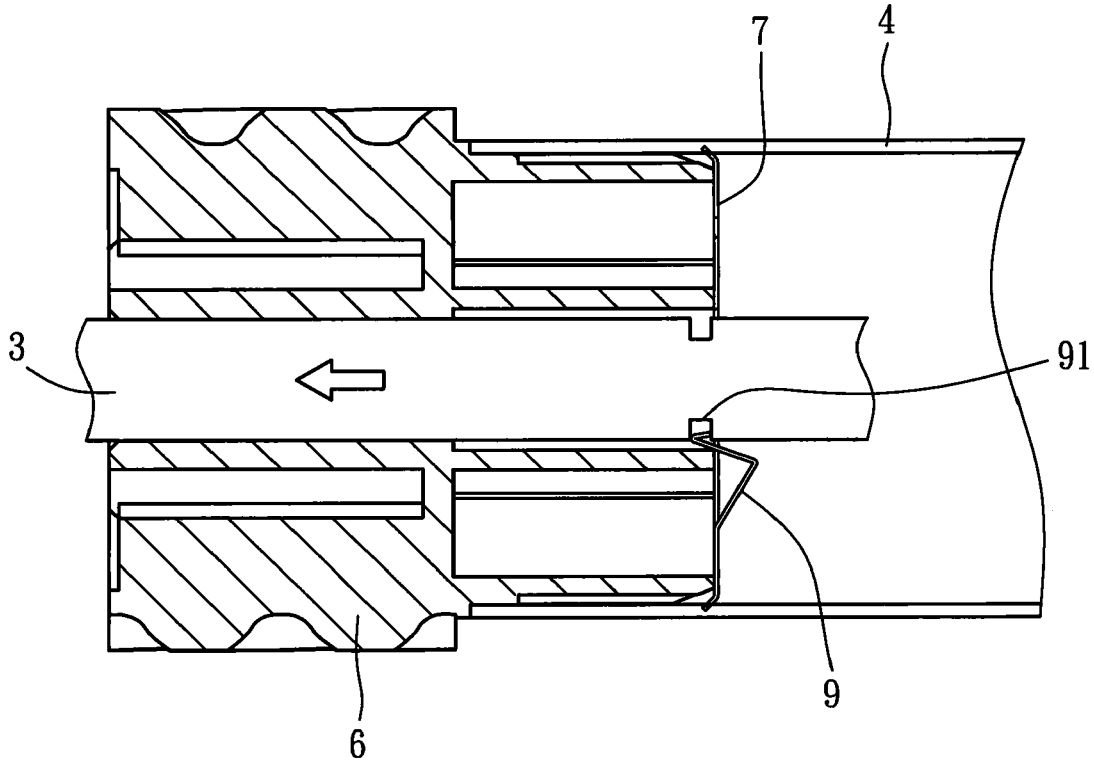
FIG. 5 PRIOR ART
FIG. 5 is similar to FIG. 4, but showing the shaft is moved leftwards.
Figure 6:
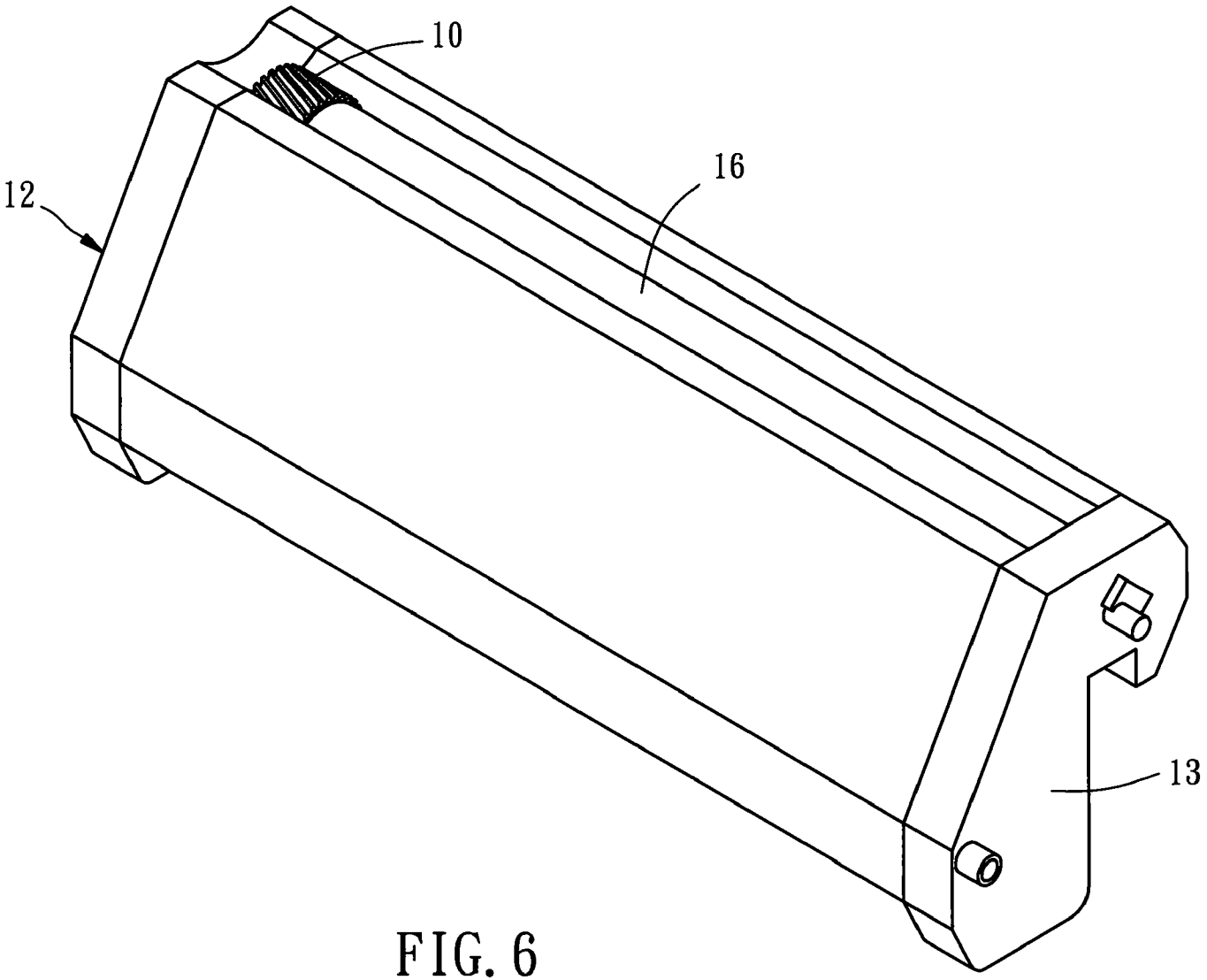
FIG. 6 is a perspective view of a photo conductor drum cartridge equipped with a driving unit according to a first preferred embodiment of the present invention.
Figure 7:
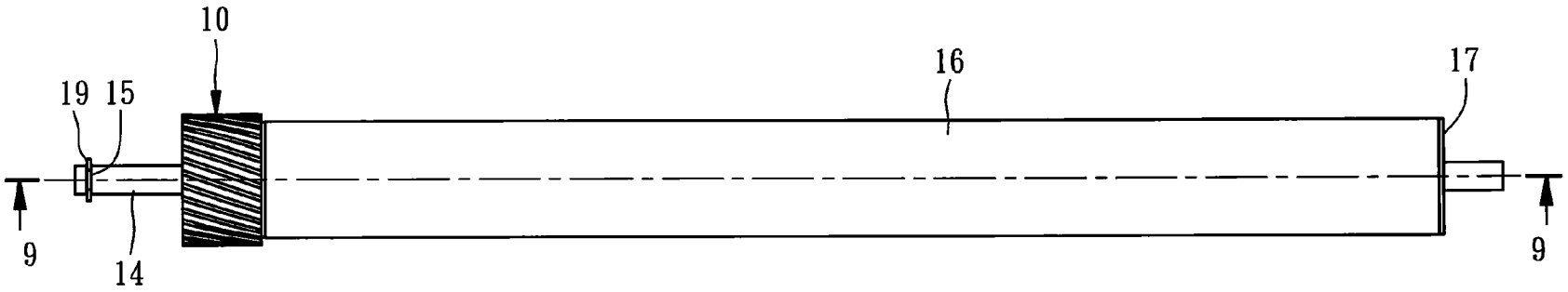
FIG. 7 is a front view, showing the driving unit according to the first preferred embodiment of the present invention is assembled with a photo conductor drum and a shaft.

As shown in FIG. 6, a driving unit 10 in accordance with a first preferred embodiment of the present invention is installed in a photo conductor drum cartridge 12. Referring to FIGS. 6-9, the photo conductor drum cartridge 12 comprises a housing 13, a shaft 14 mounted in the housing 13, a photo conductor drum 16 sleeved on the shaft 14, and a support wheel 17 engaged with the right end of the photo conductor drum 16 and provided with a axial hole 18 for penetration of the right end of the shaft 14. The shaft 14 defines a radius D and has two annular groove portions 15 for engagement with two C-shaped fasteners 19 in order to mount the shaft 14 to the housing 13. The annular groove portions 15 each define a radius d that is shorter than the radius D. The driving unit 10 comprises a gear 20 and a conducting plate 30.

The gear 20 has a main body 22, an extending portion 24 extending from the main body 22 and inserted into the photo conductor drum 16, and an axial hole 26 passing through the main body 22 and the extending portion 24 for penetration of the shaft 14. The main body 22 has teeth 23 at an outer periphery thereof for engagement with a gear (not shown) of a photocopier (not shown), allowing the gear 20 to be rotated through the meshed engagement. The extending portion 24 is shorter in diameter than the main body 22.

The conducting plate 30 has a plate body 31 mounted on the extending portion 24 of the gear 20 and abutted against an inner periphery 161 of the photo conductor drum 16, a through hole 32 formed at the plate body 31 for penetration of the shaft 14, two elastic arms 34 extending from an inner periphery 33 of the plate body 31 defining the through hole 32 toward each other for stopping against the shaft 14, and four tabs 36 extending from an outer periphery of the plate body 31 and abutted against the photo conductor drum 16. Further, the conducting plate 30 defines an imaginary axis A aligned with a center of the plate body 31 and parallel to the shaft 14.

Figure 8:
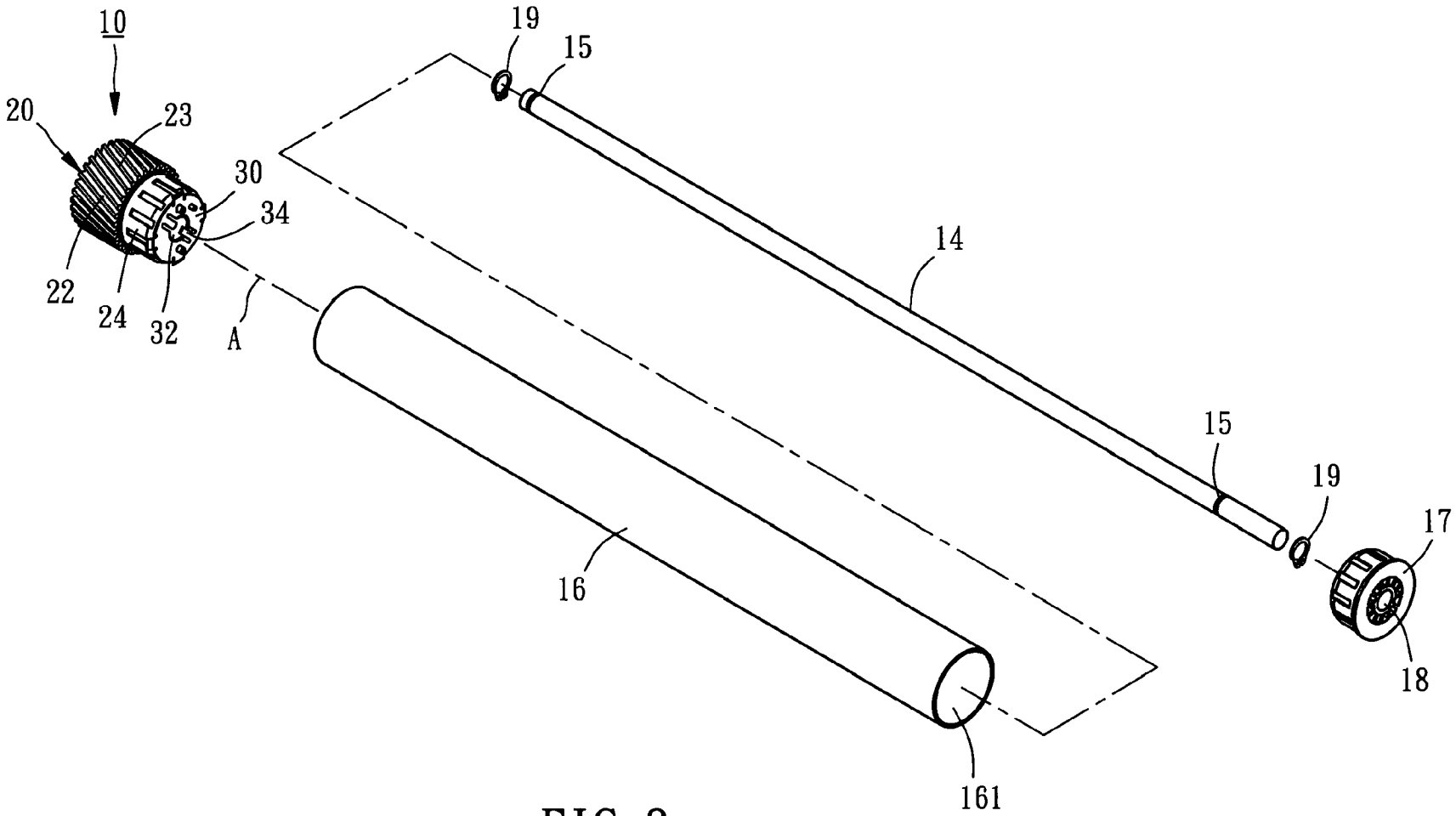
FIG. 8 is an exploded view of FIG. 7.
Figure 9:
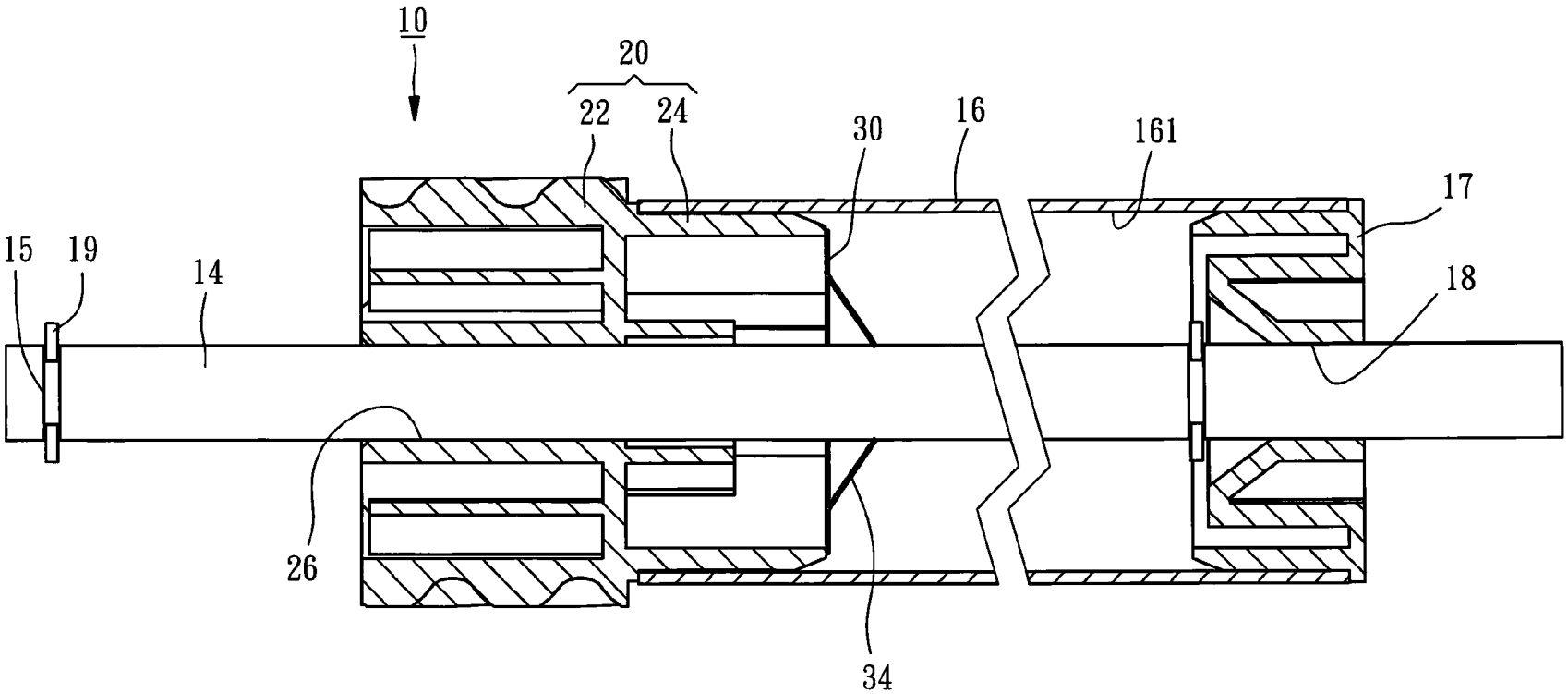
FIG. 9 is a sectional view taken along line 9-9 of FIG. 7.
Figure 10:
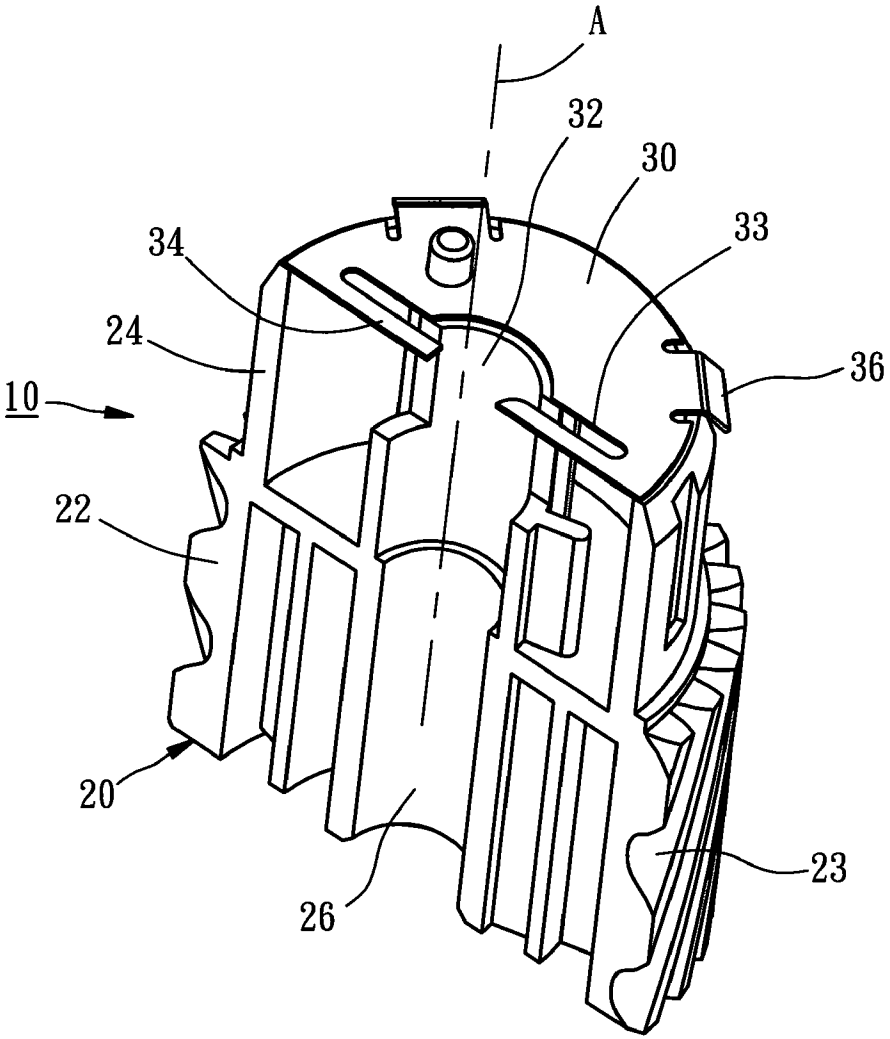
FIG. 10 is a perspective sectional view of the driving unit according to the first preferred embodiment of the present invention.
Figure 11:
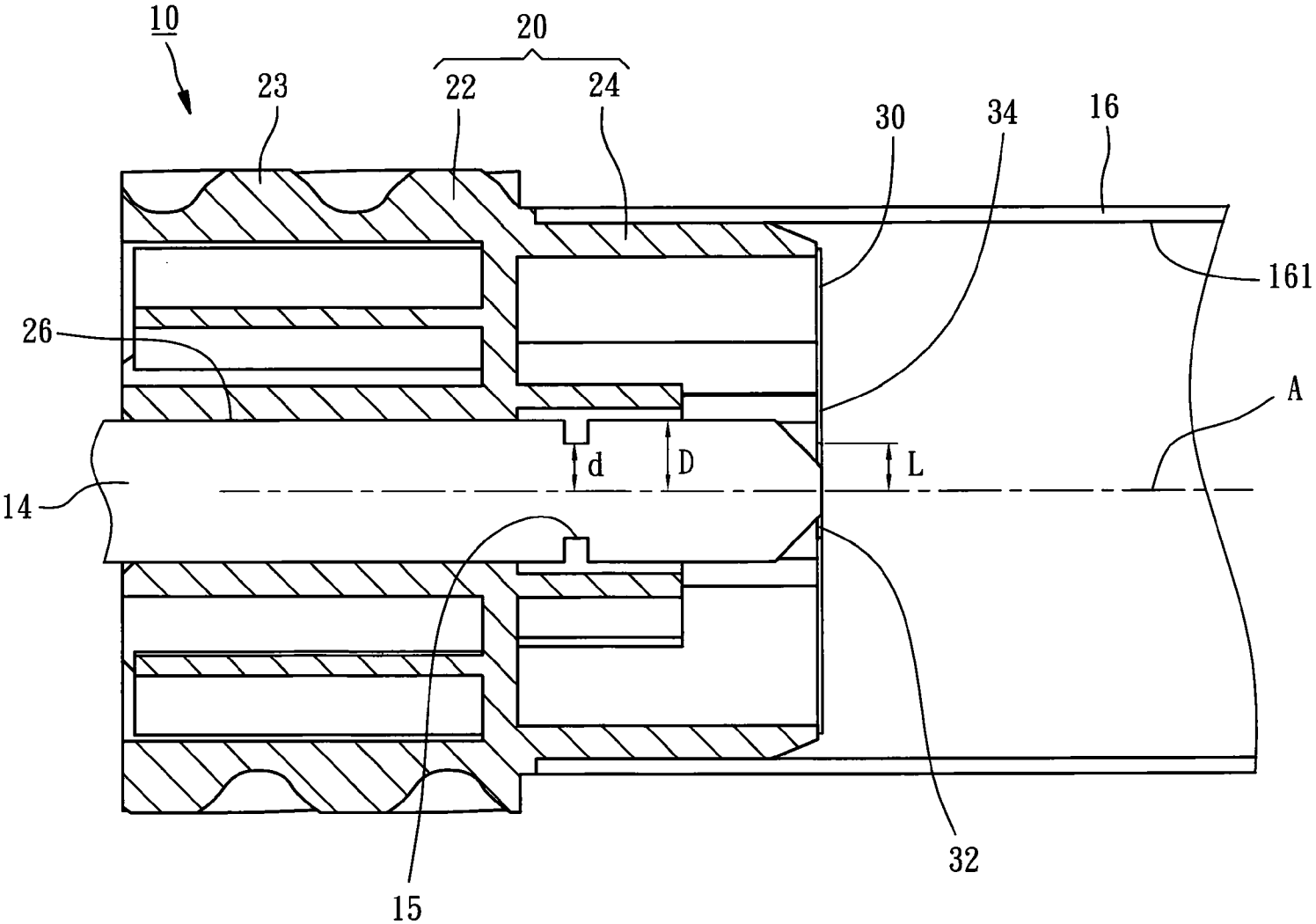
FIG. 11 is a schematic sectional drawing showing the shaft is inserted into the axial hole of the gear.

As shown in FIGS. 8 and 10, when the driving unit 10 isn't assembled with the shaft 14, the elastic arms 34 of the conducting plate 30 are aligned with each other, and the elastic arms 34 are perpendicular to the imaginary axis A. At this time, as shown in FIG. 11, a distance L is defined between a distal end of one of the elastic arms 34 and the imaginary axis A. The distance L is longer than or equal to the radius d and shorter than the radius D. On the one hand, because the distance L is shorter than the radius D, the elastic-deformed elastic arms 34 will be stopped against the shaft 14 when the shaft 14 is inserted into the through hole 32 of the conducting plate 30; on the other hand, because the distance L is longer than or equal to the radius d, the elastic arms 34 can be inserted into the annular groove portion 15 of the shaft 14 without any distortion. In order to ensure that the elastic arms 34 won't touch the bottom of the annular groove portion 15, the distance L can be designed to be longer than the radius d.

FIGS. 11 to 14 show the steps for assembling the shaft 14 with the photo conductor drum 16.

As shown in FIG. 11, the shaft 14 is inserted into the axial hole 26 of the gear 20; however, it hasn't touched the conducting plate 30 yet.

Figure 12:
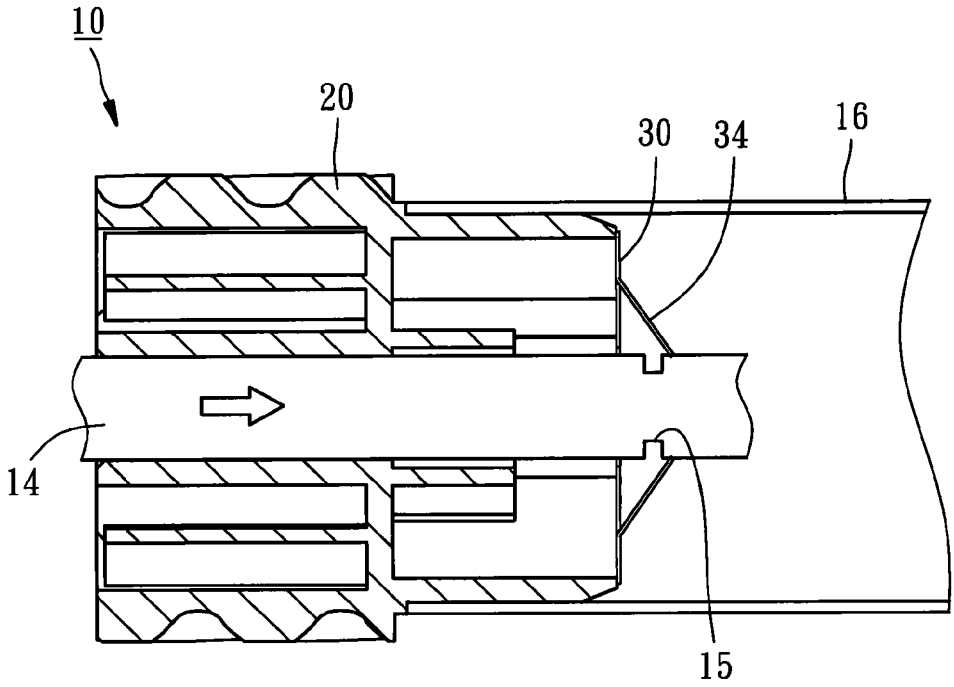
FIG. 12 is similar to FIG. 11 but showing the shaft keeps moving rightwards.

As shown in FIG. 12, when the shaft 14 is continuously moved rightwards relative to the photo conductor drum 16, the shaft 14 will push the elastic arms 34 away to cause an elastic deformation of the elastic arms 34 because the radius D is longer than the distance L.

Figure 13:
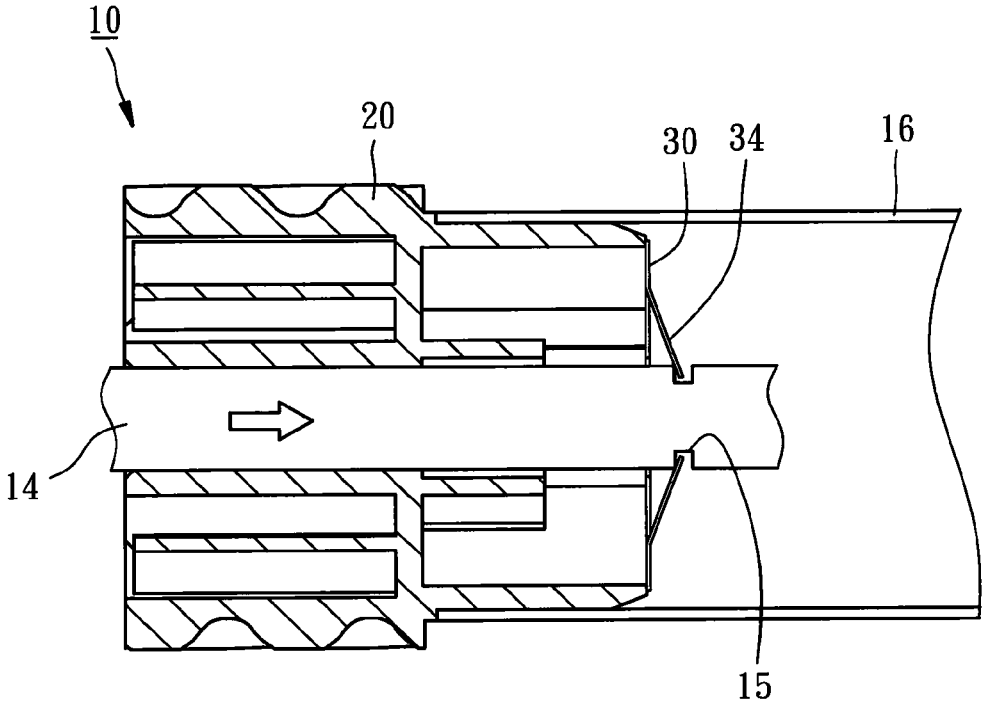
FIG. 13 is similar to FIG. 12 but showing the distal ends of the elastic arms are located in the annular groove portion of the shaft when the shaft is moving rightwards.

As shown in FIG. 13, when the shaft 14 keeps moving rightwards, the distal ends of the elastic arms 34 will be inserted into the annular groove portion 15, but won't touch the bottom of the annular groove portion 15 because the distance L is longer than or equal to the radius d.

Figure 14:
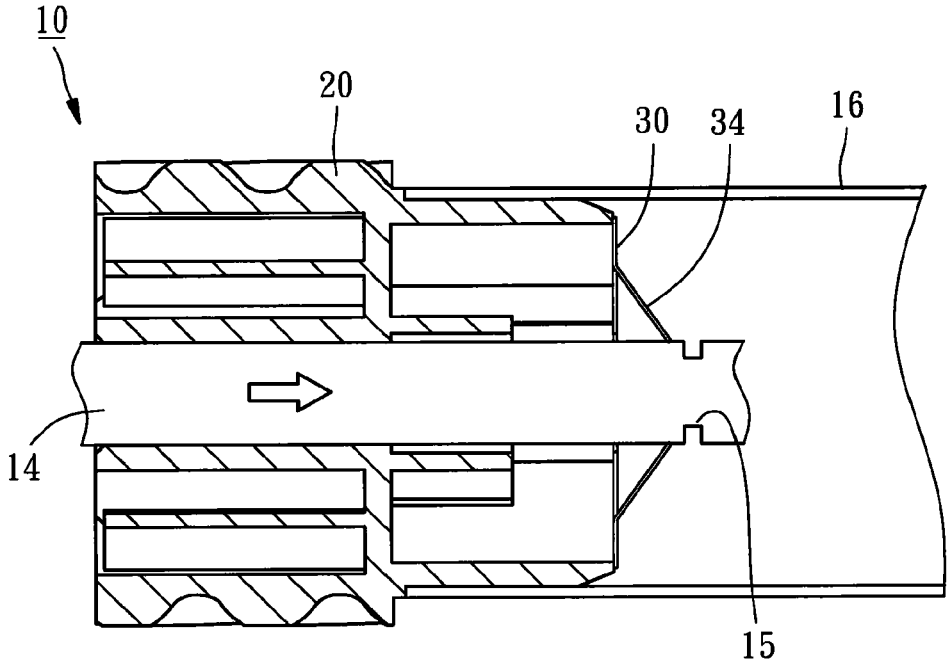
FIG. 14 is similar to FIG. 13 but showing the distal ends of the elastic arms get across the annular groove portion of the shaft and remain touched with the outer periphery of the shaft.

As shown in FIG. 14, when the shaft 14 keeps moving rightwards, the distal ends of the elastic arms 34 will run across the annular groove portion 15 and then stop against an outer periphery of the shaft 14.

FIGS. 15 to 18 show the steps for dismounting the shaft 14 from the photo conductor drum 16.

Figure 15:
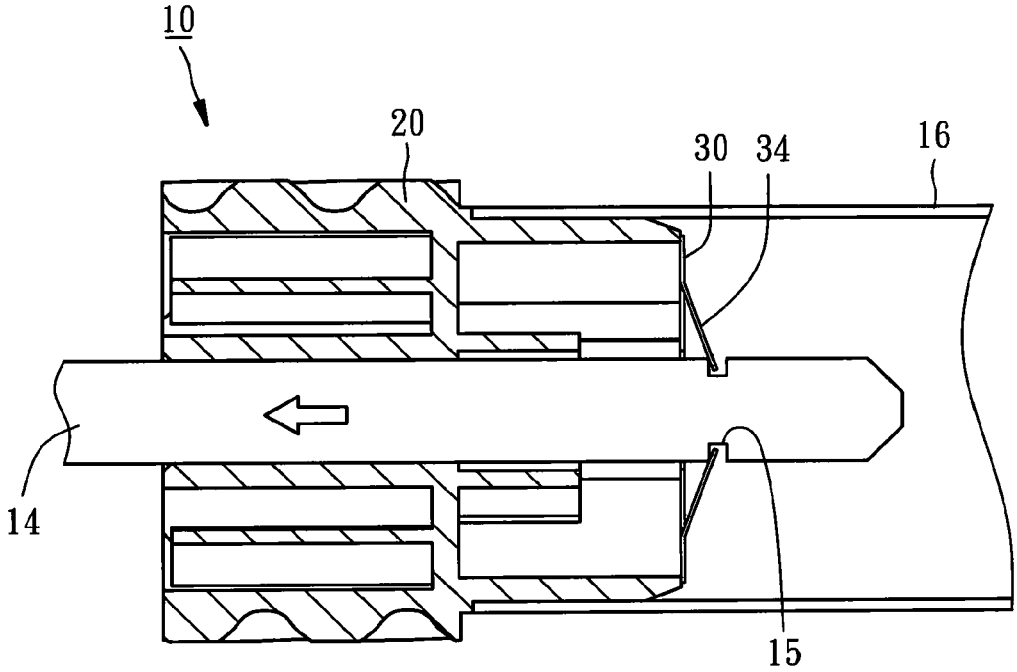
FIG. 15 is a schematic drawing showing the distal ends of the elastic arms are relocated in the annular groove portion of the shaft when the shaft is pulled to move leftwards.

As shown in FIG. 15, when the shaft 14 is pulled leftwards to a position where the annular groove portion 15 is near to the conducting plate 30, the distal ends of the elastic arms 34 will be inserted again into the annular groove portion 15 due to the rebound force of the elastic arms 34.

Figure 16:
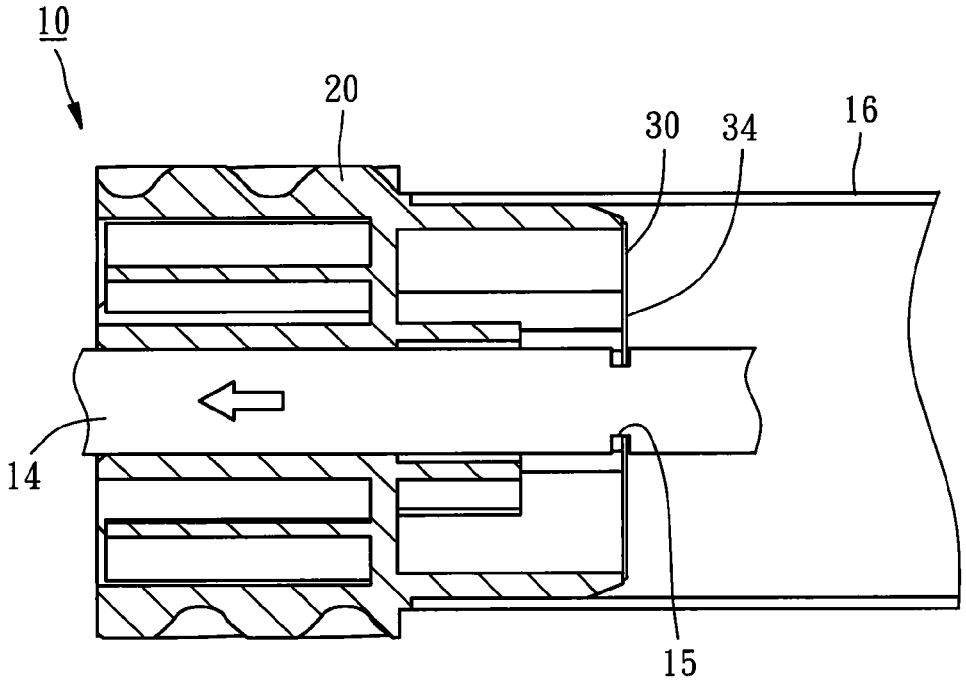
FIG. 16 is similar to FIG. 15 but showing the elastic arms and the annular groove portion of the shaft are located at the same plane when the shaft is moving leftwards.

As shown in FIG. 16, when the shaft 14 keeps moving leftwards to a position where the annular groove portion 15 and the conducting plate 30 are located at the same plane, the distal ends of the elastic arms 34 which are inserted into the annular groove portion 15 won't jam at the bottom of the annual groove portion 15 because the distance L is longer than or equal to the radius d, such that the elastic arms 34 won't become distorted when the shaft 14 is continuously pulled leftwards.

Figure 17:
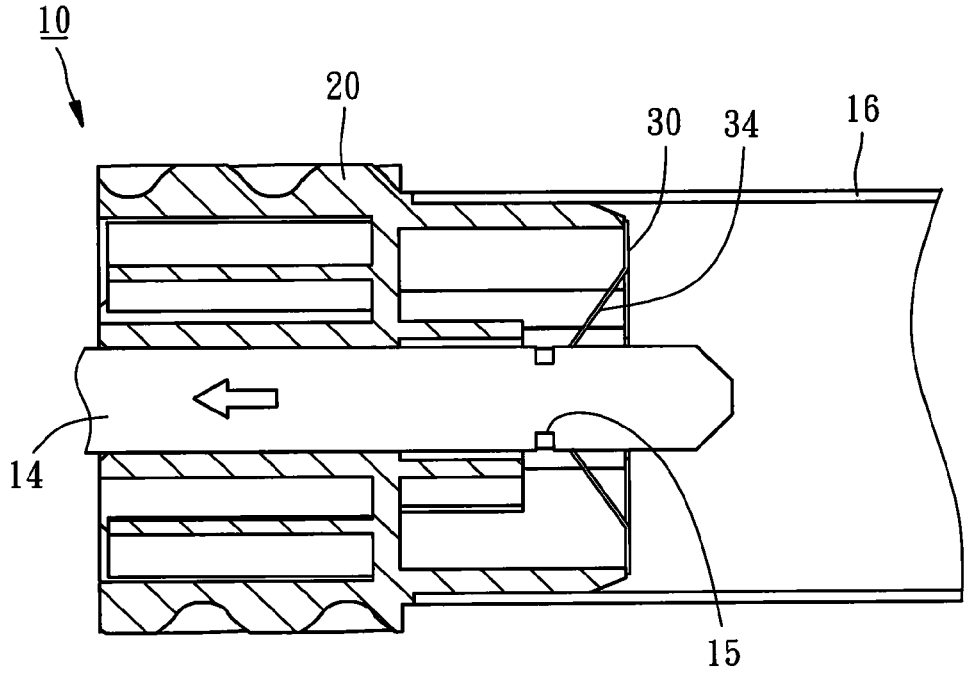
FIG. 17 is similar to FIG. 16 but showing the distal ends of the elastic arms slide out of the annular groove portion of the shaft when the shaft keep moving leftwards.

As shown in FIG. 17, when the shaft 14 keeps moving leftwards, the elastic arms 34 become deformed leftwards and the distal ends of the elastic arms 34 will slide out of the annular groove portion 15 and then stop against the outer periphery of the shaft 14 again.

Figure 18:
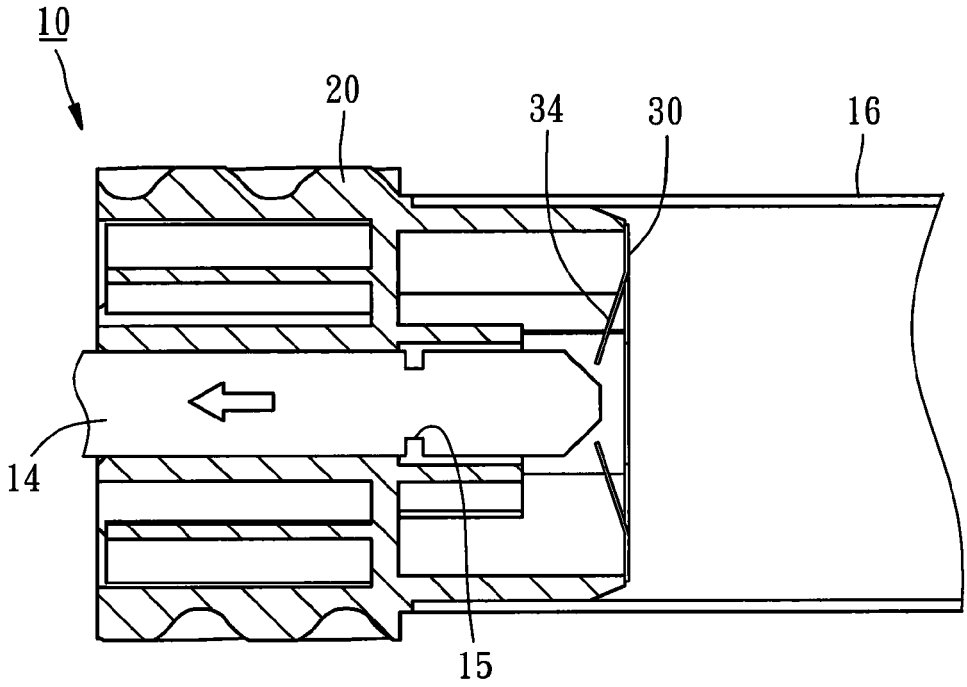
FIG. 18 similar to FIG. 17 but showing the shaft is separated from the conducting plate when the shaft keeps moving leftwards.

As shown in FIG. 18, when the shaft 14 keeps moving leftwards to a position where the shaft 14 is totally separated from the conducting plate 30, the deflection angles of the elastic arms 34 will be reduced due to the elasticity of the elastic arms 34.

In the process of detaching the shaft 14 from the photo conductor drum 16, the elastic arms 14 won't become distorted such that the shaft 14 can be smoothly drawn out of the driving unit 10. When a repaired or new photo conductor drum 16 is assembled with the driving unit 10 and the shaft 14, the elastic arms 34 will be pushed by the shaft 14 back to the condition shown in FIG. 11, and then a maintenance worker can follow the steps shown in FIGS. 11 to 14 to finish the assembly of the photo conductor drum cartridge of the present invention. In other words, the conducting plate 30 won't get damaged when the shaft 14 is dismounted from the photo conductor drum 16; therefore, the conducting plate can be reusable.

Figure 19:
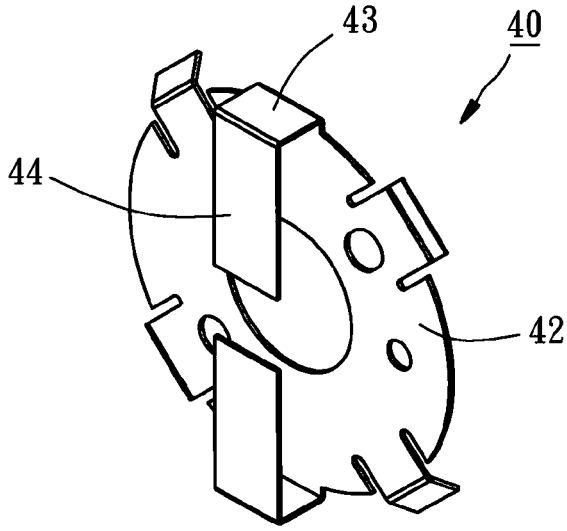
FIG. 19 is a perspective view of the conducting plate of the driving unit according to a second preferred embodiment of the present invention.
Figure 20:
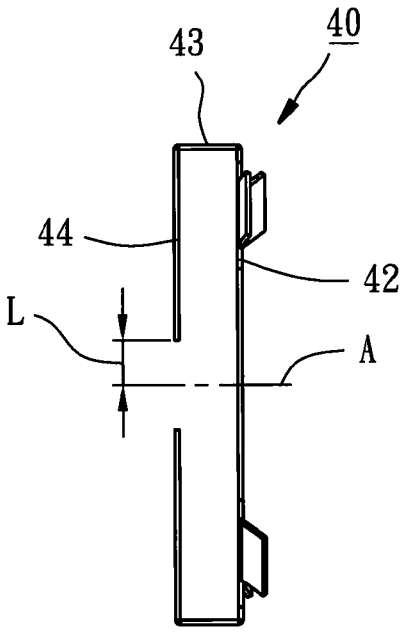
FIG. 20 is a lateral view of the conducting plate of the driving unit according to the second preferred embodiment of the present invention.

The driving unit can be made with various kinds of design on the basis of the spirit of the present invention, especially the conducting plate. FIGS. 19 and 20 show a conducting plate 40 of a driving unit in accordance with a second preferred embodiment of the present invention.

The conducting plate 40 has two bending portions 43 bent from the outer periphery of the plate body 42, and two elastic arms 44 each extending from a distal end of one of the bending portions 43. When the elastic arms 44 of the conducting plate 40 are perpendicular to the imagery axis A, the distance L, the radius D and the radius d are still confirmed to the above-mentioned relationship, i.e. $D>L\geqq d$.

Figure 21:
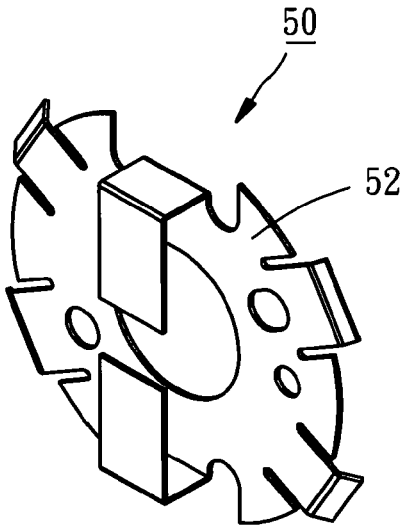
FIG. 21 is a perspective view of the conducting plate of the driving unit according to a third preferred embodiment of the present invention.

Besides, FIG. 21 shows a conducting plate 50 of a driving unit in accordance with a third preferred embodiment of the present invention. The conducting plate 50 is similar to the conducting plate 40, but has a plate body 52 of different shape compared to the plate body 42 of the conducting plate 40.

Further, the conducting plate can be provided with at least one elastic arm and at least one tab, and the elastic arms are unnecessary to be aligned with each other.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A driving unit for a photo conductor drum cartridge having a housing, a shaft mounted in the housing and having a radius D and an annual groove portion with a radius d shorter then the radius D, and a photo conductor drum sleeved on the shaft, the driving unit comprising:

a gear having a main body, an extending portion extending from the main body for inserting into the photo conductor drum, and an axial hole passing through the main body and the extending portion for penetration of the shaft; and a conducting plate having a plate body mounted on the extending portion of the gear for abutting against an inner periphery of the photo conductor drum, a through hole formed at the plate body for penetration of the shaft, and an elastic arm extending from the plate body for stopping against the shaft, and defining an imaginary axis aligned with a center of the plate body and parallel to the shaft;

wherein when the elastic arm of the conducting plate is perpendicular to the imaginary axis, a perpendicular distance L is defined between a distal end of the elastic arm and the imaginary axis and the distance L is longer than or equal to the radius d and shorter than the radius D, so that when the elastic arm is perpendicular to the imaginary axis, the distal end extends into the annual groove portion and remains unbent in the annual groove portion.

2. The driving unit as claimed in claim 1, wherein the plate body of the conducting plate has a tab at an outer periphery thereof for abutting against the inner periphery of the photo conductor drum.

3. The driving unit as claimed in claim 1, wherein the distance L is longer than the radius d.

4. The driving unit as claimed in claim 1, wherein the conducting plate has two said elastic arms.

5. The driving unit as claimed in claim 4, wherein the elastic arms are aligned with each other.

6. The driving unit as claimed in claim 1, wherein the elastic arm of the conducting plate extends from an inner periphery of the plate body defining the through hole.

7. The driving unit as claimed in claim 1, wherein the elastic arm extends from a distal end of a bending portion bent from an outer periphery of the plate body of the conducting plate.

* * * * *